US005508899A

United States Patent [19]

McCormick

[11] Patent Number: 5,508,899

[45] Date of Patent: Apr. 16, 1996

[54] SHOE LIGHT ATTACHMENT

[76] Inventor: Arnold J. McCormick, 2455 Oakwood Manor Dr., Florissant, Mo. 63031

[21] Appl. No.: 243,373

[22] Filed: May 16, 1994

[51] Int. Cl.[6] ..... F21L 15/08

[52] U.S. Cl. ..... 362/103; 362/191; 362/396; 36/137

[58] Field of Search ..... 36/137, 139, 136; 362/103, 190, 191, 396, 382

[56] References Cited

U.S. PATENT DOCUMENTS

| | | | |
|---|---|---|---|
| 2,233,544 | 3/1941 | McKinley | 36/137 |
| 2,557,663 | 6/1951 | Knode | 36/137 |
| 3,501,144 | 3/1970 | Schmidt | 36/139 |
| 4,438,482 | 3/1984 | Leon et al. | 362/103 |
| 5,033,212 | 7/1991 | Evanyk | 36/137 |
| 5,149,489 | 9/1992 | Crews | 362/103 |

FOREIGN PATENT DOCUMENTS

| | | | |
|---|---|---|---|
| 0534560 | 3/1993 | European Pat. Off. | 36/137 |
| 1070231 | 7/1954 | France | 36/137 |
| 184738 | 10/1936 | Switzerland | 36/137 |
| 177246 | 3/1922 | United Kingdom | 362/103 |
| 388973 | 3/1933 | United Kingdom | 36/137 |

*Primary Examiner*—Denise L. Gromada
*Assistant Examiner*—Alan B. Cariaso
*Attorney, Agent, or Firm*—Polster, Lieder, Woodruff & Lucchesi

[57] ABSTRACT

An attachment for a shoe or boot includes a wishbone or spur element that fits around the quarters (or foxing or outer counter portion, depending upon its construction) of the shoe or boot. The element carries lamps that are visible when viewed toward the back of the shoe. The lamps are electrically connected to a source of current, generally a battery, which is carried either by the element itself, or by a casing to which the element is adjustably attached. The wishbone or spur element is preferably mounted by or aided in its mounting by a hook and loop fastener of the type sold under the trademark VELCRO.

15 Claims, 2 Drawing Sheets

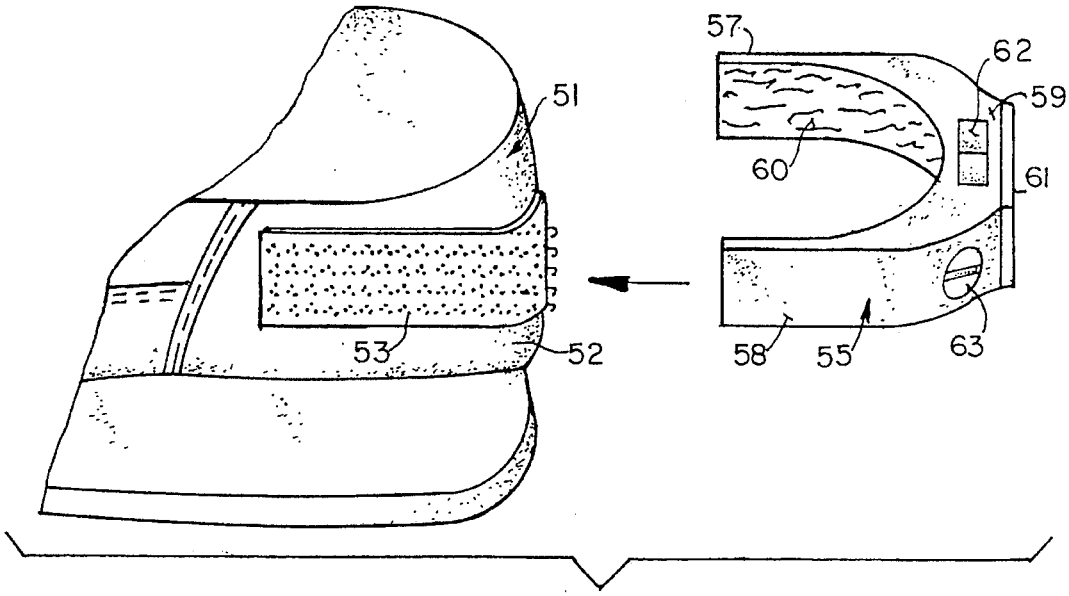
FIG. 4
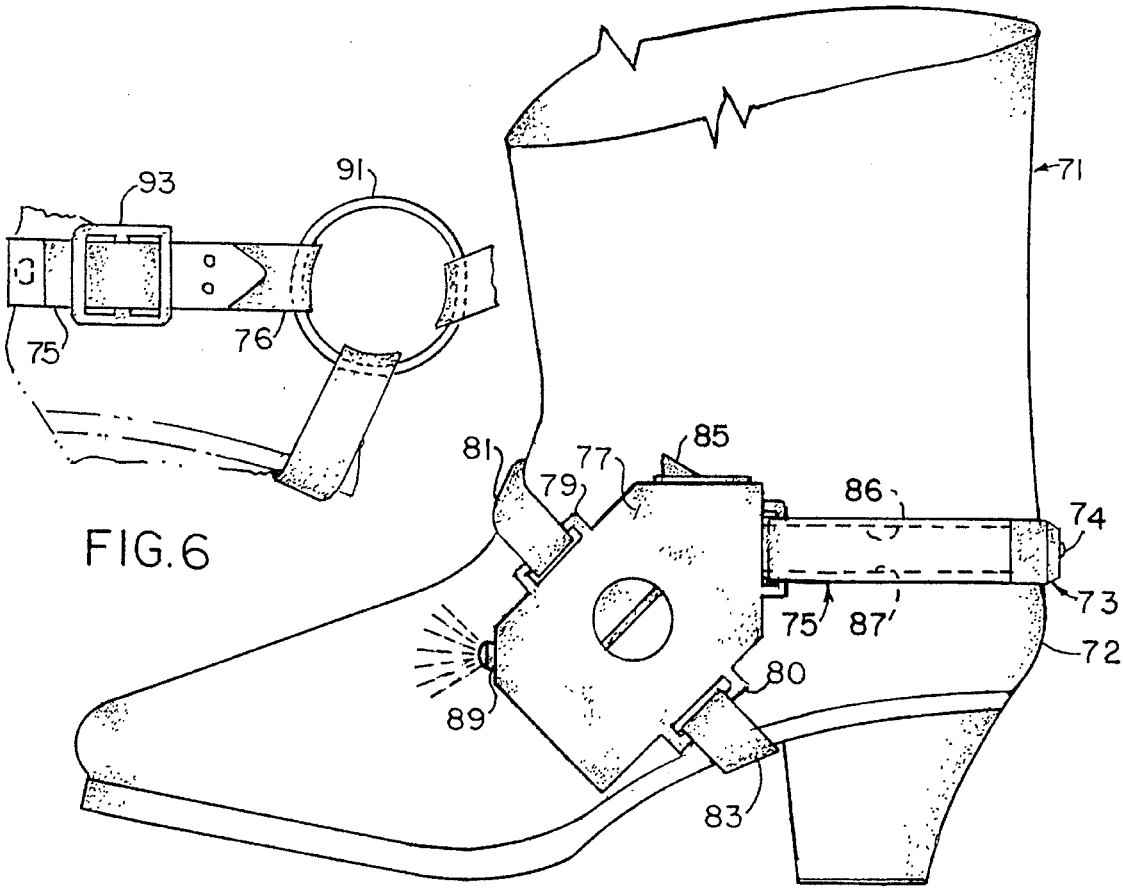
FIG. 6
FIG. 5

SHOE LIGHT ATTACHMENT

BACKGROUND OF THE INVENTION

Shoes with built-in heel lights have become popular, and have been the subject of patents going back at least thirty years (See U.S. Pat. No. 2,941,315, for example). Recently, athletic shoes with built-in lights that are turned on and off in response to switches in the heels or other built-in circuitry, have become particularly popular. These shoes are expensive and, their unique appearance cannot readily be changed.

A footwear area which has become increasingly popular is the western style boot. As far as Applicant is aware, no such boot has been equipped with built-in heel illuminators, but at the same time, western style dancing is becoming increasingly popular.

One of the objects of this invention is to provide a shoe attachment, applicable to western style boots, which can be mounted and demounted selectively and readily, and which provides illumination around the shoe or boot immediately above the heel.

Another object is to provide such an attachment which is adapted to be attached to boots and shoes of a wide variety of sizes.

Other objects will become apparent to those skilled in the art in the light of the following description and accompanying drawing.

BRIEF DESCRIPTION OF THE INVENTION

In accordance with this invention, generally stated, an attachment for a shoe or boot comprises a wishbone or spur element, which carries light means which can take the form of light emitting diodes or the like. In the simplest form of the invention, the wishbone, which is generally U-shaped in plan, with legs that are generally parallel with one another, carries a battery, to which lights carried by the wishbone are electrically connected, and a switch. A strip part of a hook and loop fastener extends around the inside of the U-shaped wishbone element, facing a counterpart strip of hook and loop fastener that is adhered to the quarter of a shoe, above the heel, although if the heel is sufficiently high, it can be mounted around the heel itself. In this embodiment, the legs of the wishbone are stiffly resilient, and can be pulled away from one another to facilitate their mounting on the shoe, and to accommodate somewhat different widths of the shoe.

In the preferred embodiment, the attachment is designed for use with western style or cowboy boots. In this embodiment, a spur element, also generally U-shaped in plan, has spaced, oppositely disposed legs and a bridging piece between them. Light means are carried along the outside of the bridging piece and are connected to conductors that run through one of the legs. In the illustrative embodiment, the contacts extend along two sides of a prong of electrically insulative material, and are slidably received between contacts in a casing that, among other throngs, houses a battery electrically connected to the casing contacts. In this embodiment, a dummy casing shaped and sized comparably with the battery casing, receives a prong on the end of the opposite leg. The casings are mounted on a boot by means of straps, one of which runs under the shank of the boot, and another over the instep. The straps can be decorative, simulating the straps and chains of a western spur.

In still another embodiment, the battery casing is connected to conductors in a strap with a spur light attached to the strap and a free end adapted to be received in a buckle.

The buckle is carried by a buckle strap, to one end of which the buckle is connected and to the other end of which, a ring, to which a shank strap and an instep strap are connected.

DRAWINGS

In the drawings, FIG. 1 is an exploded view of one embodiment of spur light assembly of this invention;

FIG. 4 is an exploded view in top perspective of the spur or wishbone light of FIG. 2, in the process of being installed on a shoe;

FIG. 5 is a view in side elevation of a boot on which a third embodiment of spur light of this invention is installed; and FIG. 6 is a fragmentary detail view showing a connecting ring to which straps are connected.

DETAILED DESCRIPTION

Figure 1:
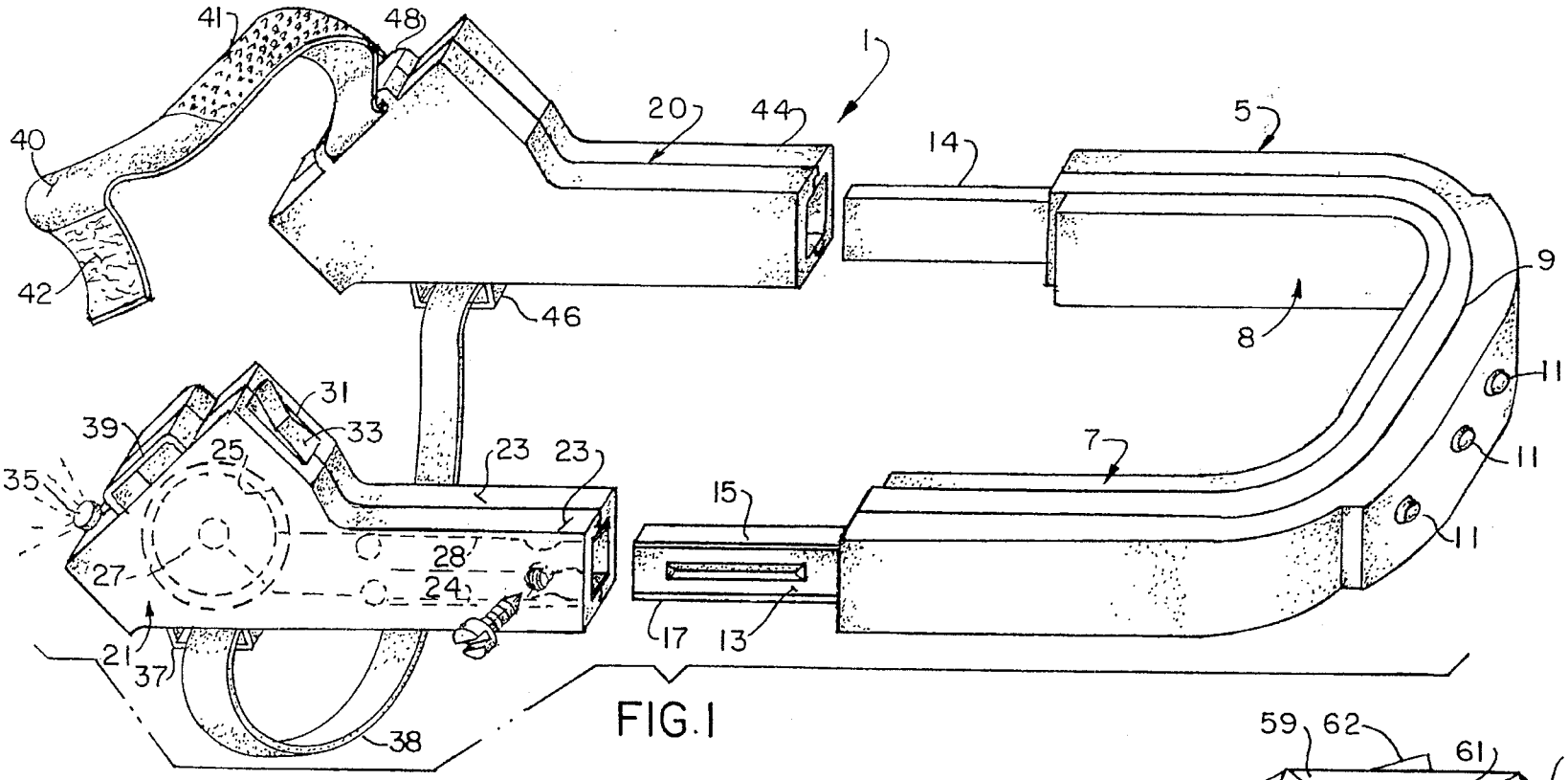

Referring now to FIG. 1 of the drawing for a preferred embodiment of this invention, reference numeral 1 indicates a spur light assembly, for installation on a boot of the type shown in FIG. 4. The assembly 1 includes a spur element 5, U-shaped in plan, with a leg 7 and a leg 8, and a bridging piece 9 between outer ends of the legs. Spur lamps 11, which can be LEDs or any other of the well known miniature lamps that require little current and can be caused to flash intermittently if desired, are mounted in and, in this embodiment, project a short distance from the bridging piece 9, so as to be highly visible from the back of the boot.

Figure 2:
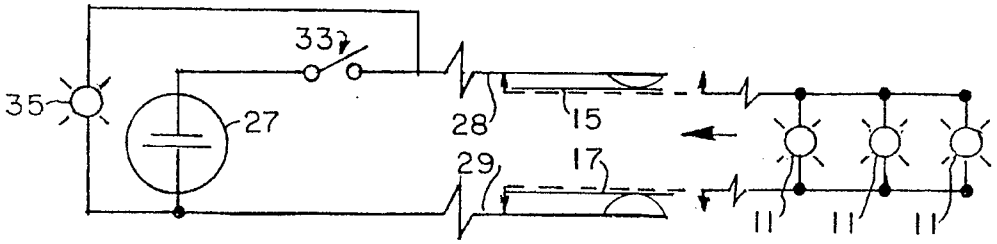
FIG. 2 is a circuit diagram

A prong 13 is integral with and projects lengthwise outwardly from the leg 7, and a prong 14 is integral with and projects lengthwise outwardly from the leg 8. An electrically conductive upper contact strip 15 extends along an upper flat surface of the prong 13, and a lower contact strip 17 extends along a lower flat surface of the prong 13, parallel with one another. The prong 13 is made of an electrically insulative material, so that the two contact strips are electrically insulated from one another. The strips 15 and 17 are electrically connected to the lamps 11, as indicated in the circuit diagram of FIG. 2. In this embodiment, a dummy casing 20 is mounted on one side of the boot, and a battery casing 21, on the other. Both of the casings are shown as being made in two halves, with the usual rabbetted edges. The battery casing 21 has in it a battery receptacle 25 in which a battery 27 is seated. The battery has terminals one of which is electrically connected directly to a lower conductor 29 that extends along an inner surface of the casing parallel with and constructed to make sliding electrical contact with the lower contact strip 17 of the prong 13, and, another of which is electrically connected mediately through a switch 33, with an upper conductor 29, also mounted on an upper inner flat surface of the casing 21 parallel to and constructed to make sliding electrical contact with the upper contact strip 15 of the prong 13. In the illustrative embodiment shown, both conductors 28 and 29 have in them a bulge 30, which serves to insure sliding but effective electrical contact with their respective contact strips of the prong 13. As can be seen, the switch 33 is mounted in a switch receptacle in the casing 21. In this illustrative embodiment, a front lamp 35 is mounted in the casing, and electrically connected to the battery by way of the switch 33, as shown in the diagram of FIG. 2.

The casing 21 has a shank strap bracket 37 and an instep strap bracket 40. The dummy casing 20 has a shank strap bracket 46 and an instep strap bracket 48. A shank strap 38 extends between and is mounted on the brackets 37 and 46. An instep strap 40 is, in the embodiment shown, mounted securely at one end in the strap bracket 48 of the dummy casing 20, and is provided on its outer surface with spaced complementary strips of hook and loop type fastener material. In the illustration, a strip 41 of the hook strip extends from the dummy bracket 48 through a substantial part of the length of the strap, and a loop strip 42 is secured to the strap at its free end. The free end of the strap is passed through the bracket 39, looped over, tightened as much as is desired, and fastened to the hook part 41, as is evident from FIG. 1.

In this embodiment, a set screw 50 is threadedly mounted in an internally threaded hole in a side surface of the battery casing 21, near the rear end of the casing, to engage a side surface of the prong 13. A similar set screw can be provided in the dummy casing. Alternatively, other well known holding devices can be used, and if, as to be described, the inside surface of the spur element is covered with a hook and loop type fastener material, and a similar, complementary, strip of the fastener is mounted on the boot, as suggested in FIG. 4 with respect to a shoe, the set screw or its equivalent can be eliminated.

It can be appreciated that the spur element can be made in many different designs, to suit the fancy or the fashion of the time. For example, a lighted rowel-like part can be made a part of or attached to the outer part of the bridging piece.

Figure 3:
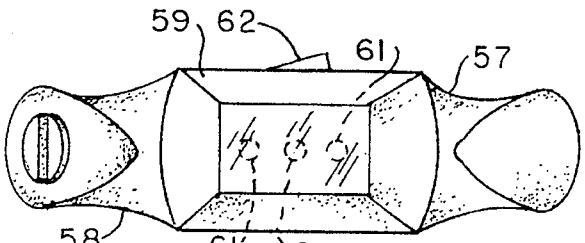
FIG. 3 is a view in rear elevation of another embodiment.

Referring now to FIGS. 3 and 4 for another, simple form of this invention, reference numeral 51 indicates a shoe, around a quarter (or outer counter or foxing, depending upon the construction of the shoe) of which a strip of one element of a hook and loop type fastener is adhered. In the embodiment shown, the strip is shown as the hook part. A wishbone spur light element 55 has legs 57 and 58, and a bridging piece 59, defining, on their inner surfaces a U-shaped wall to which a loop element strip 60 is adhered. In the embodiment illustrated in FIG. 4, the legs 57 and 58 are relatively thin, compared with the legs of the spur element of the first embodiment, and are capable of flexing, somewhat stiffly, outwardly so as to facilitate their attachment to the shoe strip 53. The bridging piece 59 is sufficiently thick to house within it a battery, mounted in a battery receptacle closed by a threaded closure 63. The bridging piece contains lamp means, which can either be directly visible, or visible through a transparent or translucent cover. The lamps are electrically connected to the battery through a switch 62, much as illustrated in the electric diagram of FIG. 2, but without the sliding contacts.

Referring now to FIG. 4, a spur light assembly 70 is shown mounted on a western style boot 71. In this embodiment, a lamp holder 73 is held into position on the quarter of the boot by means of a two piece strap. The strap is made up of a conductor carrying part 75 and a buckle carrying part. The conductor carrying part 75 is anchored at one end in a casing 77, is physically connected to the lamp holder 73 intermediate the length of the strap, and has a free end section. The casing 77, like the casing 21 of the first embodiment, carries a battery with terminals, one of which is connected electrically directly to a conductor 87 that is carried by the strap part 75, and another terminal of which is connected mediately, through a switch 85, to another conductor 86, also carried by the strap part 75. The conductors 86 and 87 are electrically insulated from one another along the strap part 75, and electrically connected to lamps 74 carried by the light holder 73. As in the first embodiment, a front lamp 89 is electrically connected to the battery through the switch 85.

The casing 77 has an upper, instep strap bracket 79 and a lower, shank strap bracket 80. Unlike the first embodiment, the lower strap 83 is mounted in a ring 91; the upper strap 81 passes through the ring 91 and is looped around and secured by strips of hook and loop fastener, as was the strap 38 of the first embodiment, but on the opposite side. A buckle strap part 92, mounted on the ring 91, carries a buckle 93 through which the free end of the light holder strap part is drawn to hold the light holder firmly in position. It can be seen that the casing 77 can be mounted on the inner side of the boot and the buckle 93, on the outer side.

As has been indicated, the various lamps can be made to shine continuously or, by well known conventional circuitry, to flash. Some of the lamps themselves are constructed to flash without external circuitry.

Numerous variations in the construction of the shoe light of this invention, within the scope of the appended claims, will occur to those skilled in the art in the light of the foregoing disclosure. Merely by way of example, the casings of the first embodiment can be made identical, so that the lamps can be energized from either side, thus permitting a quick resolution of a problem if one battery goes dead. The casings can be provided with prongs, and the legs of the spur, with receiving box channels. However, in the preferred embodiment, the energized conductors are protected. The strip of hook and loop fastener element that is mounted on the shoe or boot can be adhered or otherwise fastened permanently or it can be adheredly mounted removably, as is well known in the adhesive tape art. Although the use of the hook and loop type fastener has advantages of simplicity and universal adjustability, the instep straps of the embodiments shown in FIGS. 1 and 5 can be provided with buckles, hooks and eyes, snaps or the like, and the shank strips, with strips of hook and loop fasteners or other means for permitting adjustment of the length of the straps. The dummy casing of the first embodiment can be replaced with a strap and ring arrangement similar to that of FIG. 5, with a strap-receiving slot near the end of the prong. The ring of the embodiment shown in FIGS. 5 and 6 can be of any suitable configuration, or can be replaced with another casing, and the buckle can be replaced by a hook and loop arrangement. Other means for holding the wishbone spur element on the shoe may be employed, including adhesive bonding the spur element to the shoe, or instep and shank straps as in the embodiment shown in FIGS. 1 and 3, or snap fasteners, one element of which can be mounted on a backing strip, removably or permanently adhered to the shoe in much the way as the strip of one element of the hook and loop fastener shown and described is adhered. These are merely illustrative.

Having thus described the invention, what is claimed and desired to be secured by Letters Patent is:

1. An attachment for a shoe comprising a bracket including leg means and a hollow bridging section positioned symmetrically between said leg means, said bracket being adapted to embrace a quarter portion of said shoe with said leg means extending along opposite sides of said quarter portion and said hollow bridging section extending around a back of said shoe; battery means carried within said hollow bridging section; switch means carried within said hollow bridging section and having a manipulable part extending externally of said hollow bridging section; light means mounted in said bridging section, said light means being electrically connected to said battery means through said switch means, and being exposed along an outer surface of said bridging section, and means for selectively manually mountingly and demountingly holding said bracket on and around said quarter portion of said shoe.

2. The attachment of claim 1 wherein said means for holding said bracket comprise hook and loop fastener means made up of a hook part and a separate loop part, one of said parts being mounted on said quarter portion of said shoe and the other of said parts being mounted on an inside surface of said bracket, said parts facing one another.

3. An attachment for a shoe comprising a bracket including leg means and a hollow bridging section positioned symmetrically between said leg means, said bracket being adapted to embrace a quarter portion of said shoe with said leg means extending along opposite sides of said quarter portion and said hollow bridging section extending around a back of said shoe, battery means carried within said hollow bridging section: switch means carried within said hollow bridging section and having a manipulable part extending eternally of said hollow bridging section; light means mounted in said bridging section, said light means being electrically connected to said battery means through said switch means, and being exposed along an outer surface of said bridging section, and means for selectively manually mountingly and demountingly holding said bracket on and around said quarter portion of said shoe, said bracket being stiffly resilient, and made in one piece with legs embracing side surfaces of said quarter portion.

4. An attachment for a shoe comprising a bracket including leg means and a hollow bridging section positioned symmetrically between said leg means, said bracket being adapted to embrace a quarter portion of said shoe with said leg means extending along opposite sides of said quarter portion and said hollow bridging section extending around a back of said shoe, battery means carried within said hollow bridging section; switch means carried within said hollow bridging section and having a manipulable part extending externally of said hollow bridging section; light means mounted in said bridging section, said light means being electrically connected to said battery means through said switch means, and being exposed along an outer surface of said bridging section, and means for selectively manually mountingly and demountingly holding said bracket on and around said quarter portion of said shoe, said shoe being a western type boot, and the holding means comprising straps, an under strap extending beneath a shank of said boot forward of a heel of said boot, and an over strap extending over an instep of said boot.

5. A spur light for attachment to a western style boot comprising a U-shaped spur element with two legs that are generally parallel at their free ends and a bridging part between said legs; electrically energized light means mounted on and positioned to be visible from an outside surface of said spur element; spaced electrical contact strips electrically connected to said light means and extending along a free end of one of said legs and electrically insulated from one another; sliding mounting means on the other of said legs; spur element mounting means comprising two casings, one of said casings being mounted on one side surface of said boot and the other of said casings being mounted on an opposite side surface of said boot, a battery receiver in at least one of said casings; terminal means in said battery receiver for electrical connection to terminals of a battery in said receiver, said terminal means being electrically connected to contacts complementarily positioned with respect to said contact strips of said spur element leg and adapted to make sliding electrical contact with said leg contact strips; strap means extending between said casings for mounting said casings on said boot; means for slidably connecting said spur element legs and said casings, and means for inhibiting unintended separation of said spur element and said casings.

6. The spur light of claim 5 wherein the casings have box channels opening toward said spur legs, and said spur legs have prong members projecting toward said channels, said prong members being sized to fit closely in said channels.

7. The spur light of claim 5 wherein one of said casings is a battery casing and the other of said casings is a dummy casing.

8. The spur light of claim 5 wherein the strap means include an under strap extending beneath a shank of said boot, and an adjustable over strap extending over an instep of said boot.

9. The spur light of claim 5 including switch means mounted on said battery casing, electrically connected between one of said battery terminals and one of said sliding contacts.

10. The spur light of claim 5 wherein said light means are mounted in and visible from the bridging part of said U-shaped spur element.

11. The spur light of claim 5 including light means carried on and by said battery casing at a forward part of said casing.

12. The spur light of claim 5 wherein the spur element is stiffly resilient.

13. The spur light of claim 5 wherein said spur element mounting means include hook and loop fastener means one part of which is mounted on said quarter area of said shoe and the other, on an inside surface of said spur element, facing said one part.

14. A spur light for attachment to a western style boot comprising a light bracket; electrically energized light means mounted on and positioned to be visible from an outside surface of said light bracket; light bracket strap means physically connected to said bracket and passing around a quarter area of said boot; spaced electrical contact strips electrically insulated from one another and electrically connected to said light means and extending along said strap means; a casing mounted on one side surfaces of said boot and physically connected to said strap means; a battery receiver in said casing; terminal means in said battery receiver for electrical connection to terminals of a battery in said receiver, said terminal means being electrically connected to said contact strips; casing mounting strap means connected at one end to said casing and extending between said casing and a casing strap receiving means on a side of said boot opposite the side of said boot on which said casing is mounted, said casing mounting strap means comprising a shank strap passing beneath a shank of said boot and an instep strap passing over the instep of said boot, and buckle strap means, one end of which is mounted in said strap receiving means and another end of which carries a buckle for receiving a free end of said light bracket strap means.

15. The spur light of claim 14 wherein said casing strap receiving means comprises a mounting ring, said shank strap, said instep strap and said buckle strap means being mounted on said mounting ring.

* * * * *